United States Patent [19]

Altier

[11] 4,142,297

[45] Mar. 6, 1979

[54] ARCHER'S BOW SIGHT

[76] Inventor: Anthony L. Altier, P.O. Box 286, Honesdale, Pa. 18431

[21] Appl. No.: 864,264

[22] Filed: Dec. 27, 1977

[51] Int. Cl.[2] ..... F41G 01/46

[52] U.S. Cl. ..... 33/265

[58] Field of Search ..... 33/265; 124/87

[56] References Cited

U.S. PATENT DOCUMENTS

| | | | |
|---|---|---|---|
| 2,351,103 | 6/1944 | Brown | 33/265 |
| 2,959,860 | 11/1960 | Kowalcyk | 33/265 |
| 3,063,151 | 11/1962 | Hanson | 33/265 |
| 3,284,904 | 11/1966 | Rade | 33/265 |
| 3,488,853 | 1/1970 | Altier | 33/265 |
| 3,693,262 | 9/1972 | Wood | 33/265 |

OTHER PUBLICATIONS

Altier, "Archery Innovations", 8-1968, 4 pages.

*Primary Examiner*—Richard R. Stearns
*Attorney, Agent, or Firm*—Dennison, Dennison, Meserole & Pollack

[57] ABSTRACT

In archery bow sights having spaced apart front and rear sighting elements provided with rigid attachment to the bow and extending either forwardly or rearwardly from the bow riser section rapid, easily-made fine adjustments about the vertical and lateral axes of the bow, and basic rough general technique adjustments about the vertical, lateral (two adjustments of differing sensitivity provided) and longitudinal axes are provided, in addition to a multiple-sighting line hunting sight having the same structure for the basic rough and fine adjustments.

6 Claims, 10 Drawing Figures

ARCHER'S BOW SIGHT

CROSS-REFERENCES TO RELATED APPLICATIONS

This invention is directed toward improvements in the inventor's previous U.S. Pat. No. 3,488,853 issued Jan. 13, 1970.

BACKGROUND OF THE INVENTION

1. Field of the Invention

The present invention relates to a front and back sight arrangement for an archery bow and more particularly to a front and back sight arrangement which can be readily mounted on commercially sold bows with the provision of means for both a forward and rearward positioning of the sight on the bow riser.

2. Description of the Prior Art

There are many different concepts which have been commercially developed for providing sights for archery bows both for hunting and target shooting applications. These various approaches to providing the sighting that is required for accurate archery shooting have been developed in various areas. The particular approach taken by the present inventor is described in his previous U.S. Pat. No. 3,488,853, however, although the arrangement shown in that patent disclosure has been successfully used in tournament, sport and hunting archery, there were some drawbacks relating mainly to the ability of the archer to make gross rough sighting adjustments prior to entering into the competition or hunting field and then, additionally, the ability to make finer adjustments when a particular shooting situation is presented taking into consideration the distance, elevation and wind factors that would affect the flight of the arrow from the bow to the target. It is in the area of providing these improvements in both rough and fine adjustments that the inventor has conceived and developed the apparatus of the present disclosure.

SUMMARY OF THE INVENTION

According to the present invention, a mounting plate is provided which may be attached rigidly to the riser of commercially marketed bows and which will provide a rigid support for the sight mounted either forward or rearward of the bow riser and reduce the possibility of errors being introduced into the arrow flight path caused by changes in the sighting line after adjustments have been made. Available for rigid attachment to the mounting plate is a base mounting block having parallel spring adjustment features and also vertical movement along a base bar when tightening means is released for the purpose of making a fine adjustment for elevation. This bar is provided with a scale so that previously observed adjustment ranges can be easily reestablished.

To the upper end of the base bar there is provided a top hinge extension disposed perpendicularly to the base bar. The particular top hinge extension to be used depends on whether the sight is to be mounted forward or rearward of the bow riser. A longer extension is used in the forward mounted sight. The sight when mounted in this forward position will provide greater accuracy for tournament-type shooting. At the other end of the base bar there is provided an anchor point adjustment nut and screw which in addition to providing the vertical stability of the sight, also provides a gross adjustment for elevation which is an adjustment made to compensate for changes in the distance from the bow to the target.

There is disposed from the top hinge extension and the anchor point adjustment at the lower end of the base bar, a radius bar having a radius of curvatuve approximately equal to the distance from the radius bar to the archer's sighting eye. Disposed to slide vertically on the radius bar is a slide block with rigid attachment capability to provide a fine adjustment for elevation of the sighting line. To the slide block there is attached the windage slide bar on which is attached a sight span. The sight span is disposed at right angles to the windage slide bar which is again orthogonal to the radius bar. The sight span is provided with spaced apart front and rear sight elements.

DESCRIPTION OF THE DRAWINGS

The invention and the arrangement of the various elements in the disclosure will become more readily understood as will the various rough and fine adjustments that are provided by this invention when reference is made to the accompanying drawings which show a preferred embodiment of the invention and in which.

DESCRIPTION OF A PREFERRED EMBODIMENT

Figure 1:
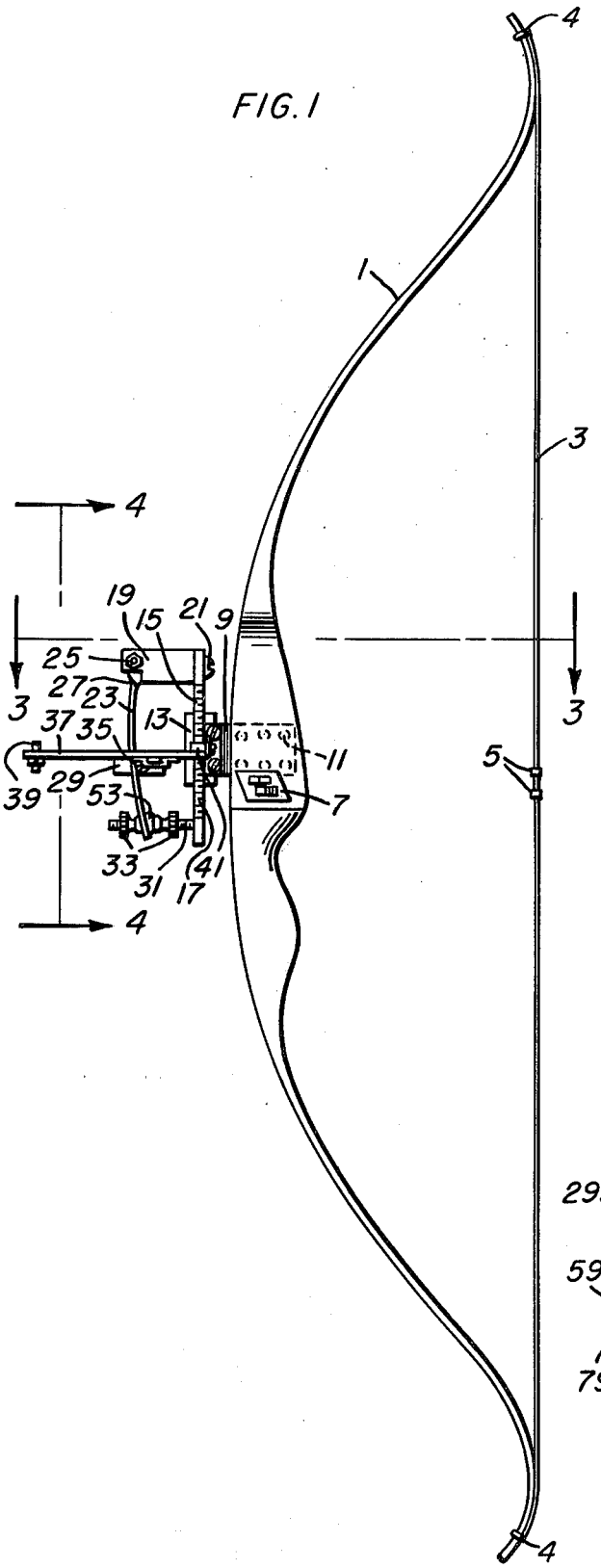
FIG. 1 is a side view of an archer's bow with the sight mounted in the forward position.

Referring now to the drawings wherein like reference numerals designate like or similar parts, and particularly to FIG. 1, there is shown a conventional recurve bow 1 having a bow string 3 and nocking points 5 thereon. The bow has an arrow rest 7 attached in the riser or window 7 of the bow 1. Attached to the bow riser is mounting plate 9 of my new sight which is secured thereto by means of mounting screws 11 shown in broken line. Attached to the mounting plate 9 is base mounting block 13 which engages slidably on base bar 15. The particular mounting means and set screw arrangements for retaining adjustments once made in the various elements will be more particularly shown with regard to later drawings.

On the side of the base bar 15 there is shown a scale 17 for the adjustments made by sliding the base mounting block along the base bar. At the upper end of base bar 15 there is attached a top hinge extension 19 secured to the base bar by base bar attachment screw 21. At the other end of the extension 19 is a hinged radius bar 23 held in position by a hinge screw 51 and locking nut 25. The radius bar 23 is adapted to pivot around the hinge screw 51 in the plane of FIG. 1. (See FIG. 2 for a better view of hinge screw 51.) There is a twist 27 in the radius bar of 90° allowing the major portion of the radius bar below the twist 27 to be basically rectangular in cross-section with the larger dimension perpendicular to the plane of FIG. 1. At its lower extremity, the base bar has a screw 31 rigidly attached thereto and extending through an aperture in the lower end of the radius bar 23 and held in place by a combination anchor point adjustment nut pair 33.

Slidably engaging radius bar 23 is a slide block 29. Attached to the slide block 29 is a windage slide bar 35 on which is slidably positioned a sight span 37 having a front sight post 39 and a rear peep sight 41.

Figure 2:
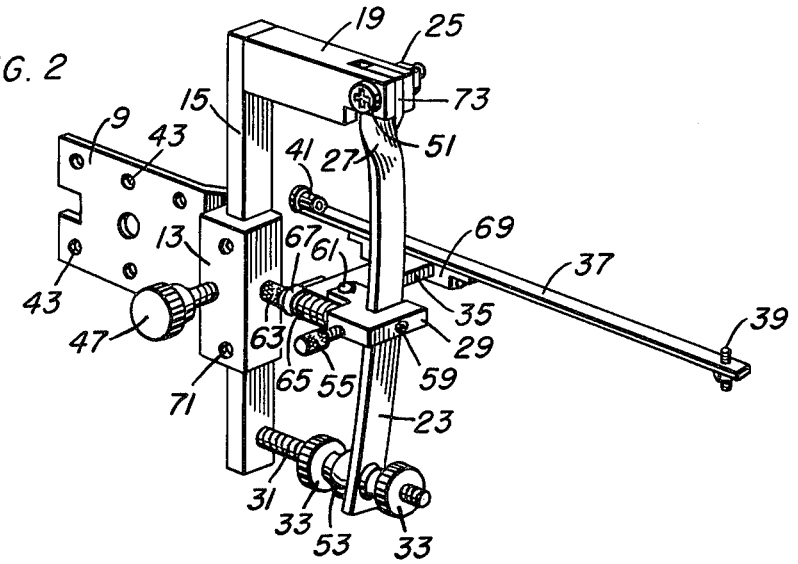
FIG. 2 is a perspective view of the sight adapted to the mounting as shown in FIG. 1.

Referring now to FIG. 2 the sight is shown in perspective view without the bow being illustrated. Mounting plate 9 is shown with apertures 43 adapted to receive mounting screws 11 of FIG. 1. Base mounting block 13 is rigidly attached to mounting plate 9 by two screws 45, shown in FIGS. 3 and 4. The base mounting block is slidably attached to base bar 15 by a counterclockwise locking nut arrangement having a finger operated adjusting knob 47 and a locking nut 49, shown in FIG. 5, rigidly attached thereto. The counterclockwise lock nut arrangement securely attaches base mounting block 13 to base bar 15 at a desired position of vertical adjustment. Top hinge extension 19 is rigidly attached to the upper end of slide bar 15 by a locking nut 21, shown in FIG. 3.

At the other end of extension 19 is a hinge with hinge nut 25 on hinge screw 51. Mounted on hinge screw 51 is radius bar 23 which has a 90° twist 27 just below the hinge position. The radius bar 23 has an aperture which receives hinge screw 51. At the end of radius bar 23 opposite hinge screw 51 there is another aperture oriented approximately orthogonal to the aperture which receives hinge screw 51. The slight variance from orthogonality is due to the curvature of radius bar 23 and will be apparent to those skilled in this art. The aperture at the end of radius bar 23 opposite from the hinge screw 51 receives an anchor screw 31 which is fixedly attached to and normal to base bar 15. The end of radius bar 23 is retained in place by two anchor point adjusting nuts 33 cooperating with a rubber compression spacer 53 on the concave side of radius bar 23. It can be seen that by adjusting the anchor point adjusting nuts 33 closer to or further away from base bar 15 on anchor screw 31, that the pitch of the radius bar will be changed in its angle with respect to the top hinge extension 19.

Slidably engaging radius bar 23 is slide block 29 which is held in a preselected position on radius bar 23 by counterclockwise elevation lock 55. Counterclockwise elevation lock 55 is integral with and operates elevation lock screw 57 (see FIG. 4). There is also provided on slide block 29 a tension elevation slide set screw 59. The purpose of slide set screw 59 is to establish the required sliding friction between slide block 29 and radius bar 23. Elevation lock screw 55 is used to set the slide block at the preselected position on radius bar 23 by drawing in elevation lock screw 57 to preclude further movement of slide block 29. Windage slide bar 35 is pivotably attached at pivot point 61 to slide block 29. The orientation of slide bar 35 relative to slide block 29 is adjusted by swivel alignment knob 63. Alignment knob 63 is fixed on a swivel alignment screw 77 (see FIG. 3) which protrudes from slide block 29 in a direction approximately orthogonal to slide bar 35 and radius bar 23 and on which there is placed a swivel alignment spring 65 held in compression by a seat against slide block 29 and a collar 67 on windage slide bar 35 which is held in place by swivel alignment knob 63.

On windage slide bar 35 there is slidably mounted a sight span 37 having a base 69 which engages slide bar 35. Sight span 37 has the two spaced apart sights; a post 39 and a peep 41. Also on base mounting block 13 there is provision for two parallel adjustment Nylok locking screws 71. It can be seen that an adjustment of one of these two adjustment screws will give a slight angular rotation of base bar 15 about an axis parallel to the sight span 37.

Figure 3:
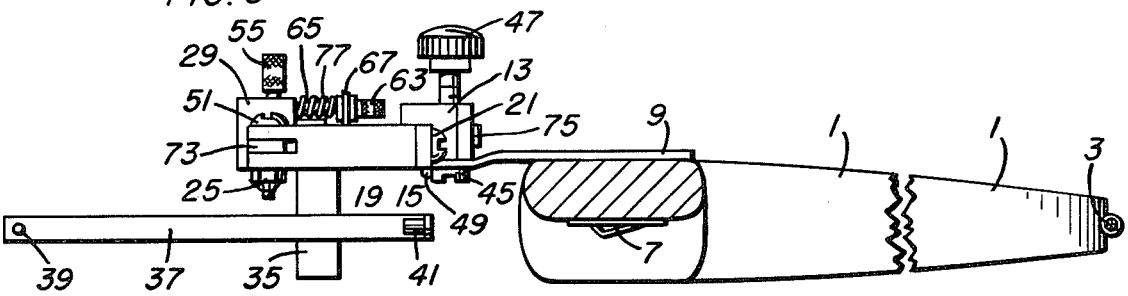
FIG. 3 is a sectional view taken along the plane 3—3 of FIG. 1.

Referring now to FIG. 3 there is shown the archer's bow 1 fragmented with bow string 3 attached to the end of the bow at bow string attachment point or groove 4. Also shown is arrow rest 7 and mounting plate 9. Base mounting block 13 is shown rigidly attached to mounting plate 9 by mounting screws 45. Base mounting block 13 moves in a direction perpendicular to the plane of FIG. 3 and is held in position on slide bar 15 by the operation of counterclockwise lock nut knob 47 which operates lock nut 49 (not fully shown in FIG. 3 — see FIG. 5). Two set screws 75 are provided on base mounting block 13 to provide a sliding friction adjustment of the mounting block on base bar 15. These two elements are of conventional design and, though not shown in FIG. 3, will be clear to those skilled in the art.

Figure 4:
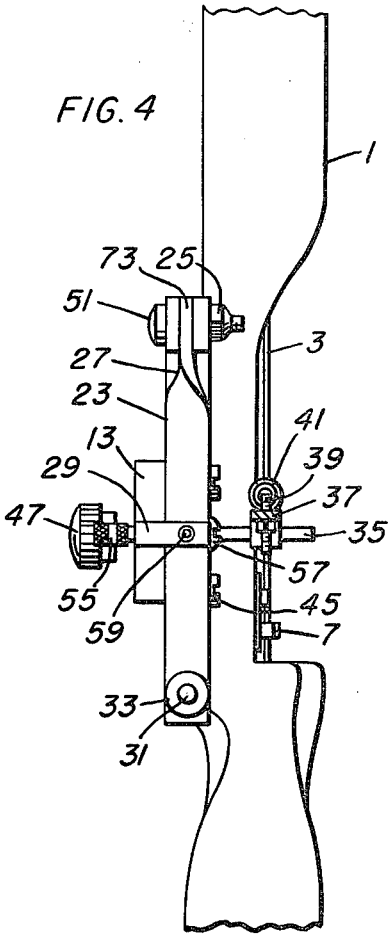
FIG. 4 is a sectional view taken along the plane 4—4 of FIG. 1.

Referring now to FIG. 4, mounting screws 45 are shown more clearly in their orientation relative to base mounting block 13. Also shown in counterclockwise elevation lock knob 55 which is spaced in front of counterclockwise lock nut knob 47 the former being integral with elevation lock screw 57. Also shown is tension elevation slide set screw 59 in slide block 29 which provides sliding friction for the slide block mounted on radius bar 23 and then held firmly in a predetermined position by the operation of elevation lock screw 57 being tightened by counterclockwise elevation lock 55. Sight span 37 is shown with forward and off sights 39 and 41 respectively aligned with the bow string 3.

Figure 5:
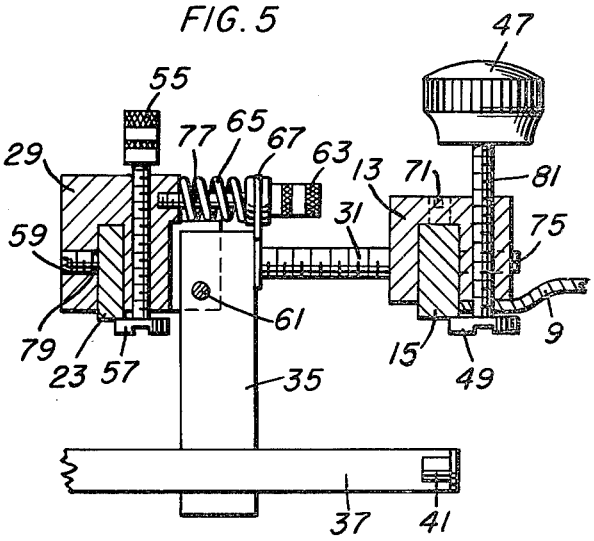
FIG. 5 is a sectional view with the section being parallel to the plane of section 3—3, but cutting through the mounting plate, the base mounting block, the base bar, the radius bar, and the slide block, showing the windage slide bar and sight span in full line.

Referring to FIG. 5, there is shown the major elements of the structure to support the sight span shown in cross-section looking from above. Thus the sight span 37 with rear peep sight 41 is supported on windage slide bar 35. Windage slide bar 35 is pivotably attached to slide block 29 on pivot 61. Rigidly attached to slide bar 35 is collar 67 through which there extends swivel alignment screw 77 which is rigidly secured in slide block 29. Swivel alignment nut 63 bears against collar 67 and holds swivel alignment spring 65 in compression bearing against slide block 29. Tension elevation slide set screw 59 is shown bearing against a nylon bearing 79 which provides sliding friction adjustment for the movement of slide block 29 on radius bar 23.

At the preselected position of slide block 29 on radius bar 23, operation of counterclockwise elevation lock nut 55 which is integral with elevation lock screw 57 secures slide block 29 in position. A Nylok locking screw 71 is shown in base mounting block 13 bearing against base bar 15. Set screws 75 are shown as they are embedded in base mounting block 13 and by proper adjustment bear against slide bar 15. Also shown is counterclockwise lock nut knob 47 which is integral with mounting screw 81 and lock nut 49 which operates to rigidly secure base mounting block 13 relative to slide bar 15 at the preselected position.

Figure 6:
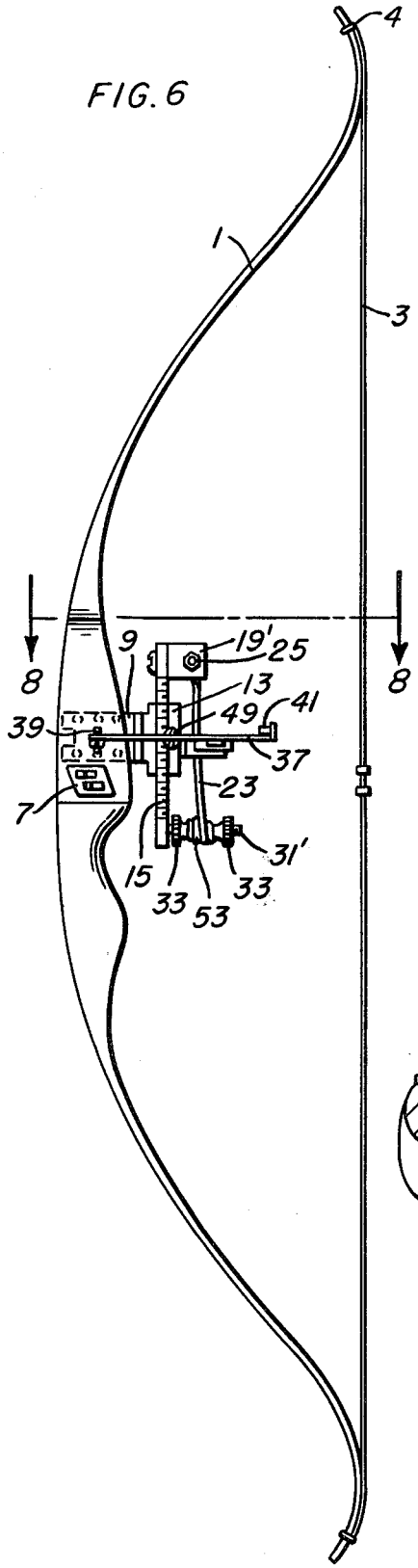
FIG. 6 is a side view of a bow having the sight mounted on the rearward face of the bow riser.
Figure 7:
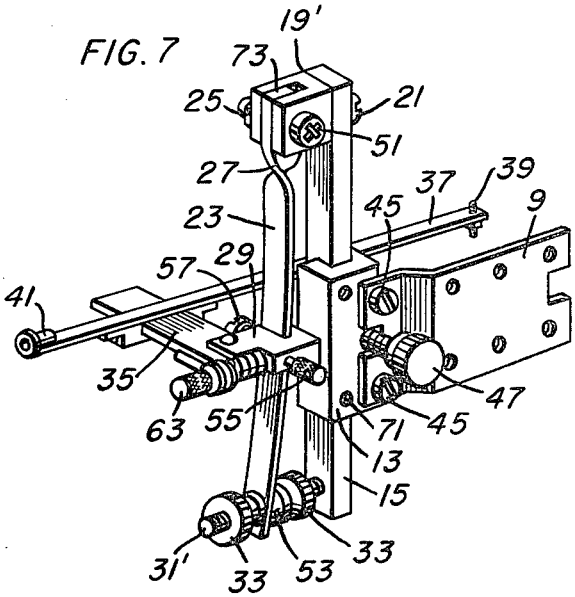
FIG. 7 is a perspective view of the sight arrangement shown in FIG. 6.
Figure 8:
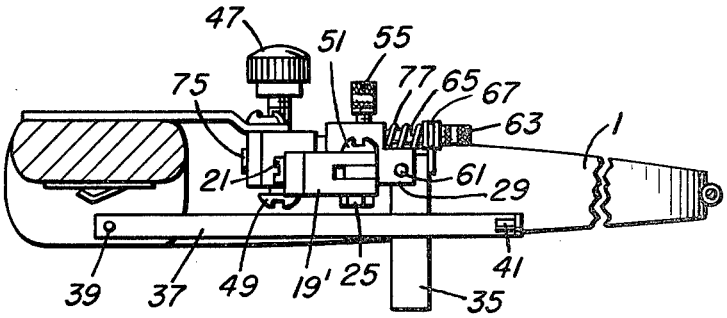
FIG. 8 is a sectional view taken along the plane 8—8 of FIG. 6.

A modified sight is shown in FIG. 6 having basically the same elements but with changes so that it can be mounted on the back or inside of the bow rather than on the face or forward side of the bow as shown in the previous figures. The same base mounting plate is used but extends rearward from the bow riser. The only differences in the structure provided for the two sights are that interchangeable parts are used to provide a shorter top hinge extension 19' and a shorter anchor screw 31', and, of course, the top hinge extension 19' and anchor screw 31' are placed on the opposite side of slide bar 15 by repositioning base bar extension attachment screw 21 and anchor screw 31'. Anchor screw 31' is a flat head screw which is rigidly attached to the slide bar through a threaded aperture. FIGS. 7 and 8 show the same relative views of this configuration of the sight as are shown in FIGS. 2 and 3 for the forward mounted sight. It should be understood that the same top hinge extension 19 and anchor screw 31 could be used here however the additional length of these two elements is not required.

The basic reason for providing the two different configurations is that the forward mounted sight is particularly adapted to tournament and target type archery wherein there is provided additional distance from the spaced apart forward and rearward sight and the archer's eye for greater accuracy. The rearward mounted sight is adapted mainly for hunters and the provision of the sight elements behind the forward portion of the bow is useful in keeping the protrusions of the sight from snagging on brush tree limbs, etc.

Figure 9:
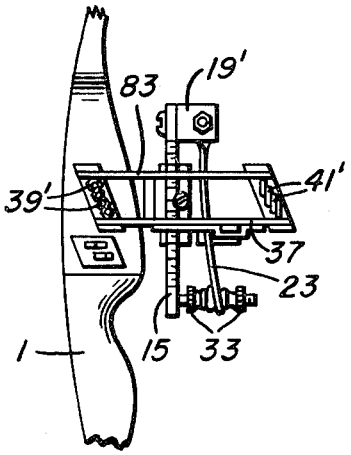
FIG. 9 is a side view of a hunting sight span having multiple sighting lines.
Figure 10:
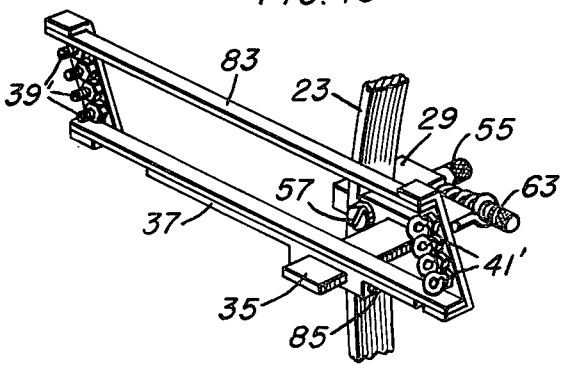
FIG. 10 is a perspective view of the hunting sight bar arrangement shown in FIG. 9.

Referring now to FIGS. 9 and 10 there is shown a modified sight span for hunters which is adapted to be used with the sight configuration shown in FIGS. 6, 7 and 8, although it could be used on the FIG. 1 form if desirable. In this configuration a plurality of sight lines is provided on the same sight span. In this particular configuration, four separate sight lines comprising rearward peep sights 41' and forward post sights 39' are used. There is also provided a top sight span stability bar 83. This provides a rigid unit adaptable to be slid on windage slide bar 35 held in place by a sight span locking screw 85.

By having both a front and back sight, the archer acquires a distinct sight picture when shooting. This sight picture forces the archer to maintain constant form. By maintaining constant form, i.e., head position, anchor point, hand position, etc. the archer continually shoots accurately. A change in the sight picture can only be properly noticed when a front and back sight is used. This enables the archer to correct his form before release of the arrow. This will give him the accuracy he desires in either tournament and sport shooting or in hunting. If the archer grips the bow too tightly, or twists the hand slightly, accidentally anchors wrong, or moves his head slightly, the sight picture will change. With the front and back sight, the archer can see his mistake and correct it before shooting. In previous sights having only the single element, the archer used a peep in the bow string above the nocking area in conjunction with the single forward sight. In my new configuration there are three elements to be aligned before the archer releases the arrow, the two sight elements and the bow string. It can be seen that greater accuracy must result with this configuration. Although it has long been recognized that a front and back sight is highly desirable, such an arrangement was not successfully provided until the present inventor disclosed such an arrangement in his previous U.S. Pat. No. 3,488,853.

The present application provides further improvements on the front and rear sight concept by providing multiple adjustment features which in combination with the front and rear sight configuration provides even greater accuracy for the archer when shooting in both tournament and hunting sports but also provides him with the ability to make the adjustments that are required for the type of shooting to be done in several areas. Gross adjustments are available in rotation about all three axes of an orthogonal coordinate axes system utilizing the sight span as a longitudinal axis and the radius bar as basically a vertical axis and the windage slide bar as the third orthogonal or lateral axis. All of these adjustments features are provided to change the angle of the front and rear sight span combination relative to the direction of the arrow when the bow is in the shooting position. Additionally there are slight adjustments transversely along the vertical axis and the lateral axis. It can be readily seen that a translational adjustment along the longitudinal axis would be unnecessary. It would be recognized that even when these various adjustments are available, there are some relatively large adjustments which can be made prior to entering the tournament or the field for hunting. In fact these gross adjustments must be made prior to the immediate period of preparing for the archer's shot. After these adjustments have been made, there are additionally some fine adjustments available to the archer to correct for slight discrepancies in his arrow flight as observed from previous shots.

Finally there is provided a multiple sight span for use in hunting so that the archer can select the sight span that he wishes to use for a particular shot depending on his quick estimate of the distance to his target within the narrow final adjustment criteria. It will be recognized that these adjustments to be valid must be made when the sight is aligned with the bow and bow string. Accordingly there is provided parallel string adjustment Nylok locking screws 71 which can be adjusted so that the slide bar 15, and consequently the radius bar 23, is parallel to the bow string 3. This is of course an adjustment that is made prior to entering the field for either tournament or hunting shooting. This adjustment is of course the angular adjustment of the sight about the longitudinal axis. The angular adjustment of the sight about the vertical axis is accomplished by the use of the swivel adjustment nut 63. This adjustment is to assure that the two sights, the front and rear sight 39 and 41, respectively, are aligned with the bow string. This adjustment also is made prior to entering the field. Now by loosening the sight span locking screw 85, the sight span on either of the sights of FIGS. 1 through 8 or the sight in FIGS. 9 and 10 can be moved laterally along the lateral axis of the sight. This adjustment is basically an adjustment for windage. It can be seen that a slight adjustment along the lateral axis will also entail a slight angular readjustment by swivel alignment knob 63. This slight adjustment is made for the purpose of adjusting for cross-wind conditions at a particular tournament site.

Now the adjustment of the sight about the lateral axis will be discussed. This is, of course, the most important of the adjustments since the elevation of the sight is directly related to the distance between the archer and his target. The first of the gross adjustments about the lateral axis is accomplished by the use of the anchor point adjustment nuts 33 which will allow movement of the lower end of the radius bar along anchor screw 31. The main reason for these adjustments is to make the center of curvature of the radius bar fall at the archer's eye position when he is in his normal shooting position. The radius bar 23 has a radius of curvature equal to the distance from the radius bar itself to the normal eye position of the archer. It can be seen that this distance will vary depending on the physique and arm length of the particular archer and of course the type or size bow being used. Different radius bars can be provided being preformed to the radius of curvature desired. Once this adjustment has been made then movement of the slide block 29 along the radius bar will not change the alignment of the sight span front and rear sights 39 and 41, respectively, and the archer's eye position. It can be seen that when the slide block 29 is moved down to a lower position that this will have the effect of raising the elevation of the line of flight of the arrow. Accordingly the position of the slide block along the radius bar is directly related to the distance between the archer and his target.

As a final fine adjustment to the angular position of the sight about the lateral axis, the counterclockwise lock nut knob 47 in conjunction with lock nut 49 can be loosened to allow the base mounting block 13 to move down on slide bar 15. This adjustment is of course the fine adjustment that can be done in the field between shots to correct slight distance errors. As is shown in FIG. 1, slide bar 23 is provided with a scale 17 so that slight corrections can be made in the elevation depending on the experience obtained from previous shots.

In a hunting situation, it can be seen that making these slight adjustments for distance between the archer and his target can rarely be made before the shot has to be taken. Accordingly, the multiple sight line sight of FIGS. 9 and 10 is provided to allow the archer to make slight elevation adjustments by using a different sight line and the orientation of the bow and the flight line of the arrow will be adjusted automatically. It can be seen that the use of the different sight lines is the equivalent of adjustment of the sight on the base mounting bar. It is of course also possible that a slight angular variation can be built into the hunting multiple sight line sight.

The invention has been described in its novel aspects; however, it is to be understood that there have been shown several embodiments of the invention and that the invention is not to be limited to the structure shown and described. The present embodiments are therefore to be considered in all respects illustrative and not restrictive. Obviously numerous modifications and variations of the present invention within the invention's true spirit are possible in light of these teachings. It is therefore to be understood that within the scope of the appended claims the invention may be practiced otherwise than as specifically described herein.

What is claimed is:

1. An archer's bow sight comprising: a sight span having spaced apart front and rear sight elements, and means for adjustably securing said sight span to the riser of a bow including; a slide block, a windage slide bar, means pivotally mounting said slide bar on said slide block for limited pivotal adjustment of the slide bar about a vertical axis generally parallel to the direction of adjustment of the slide block, said windage slide bar projecting laterally from slide block so as to extend generally laterally of said bow, means slidably mounting said sight span on said slide bar for selective positioning of said sight span along said slide bar to correct for cross-wind effects on the flight path of an arrow shot from said bow, means for pivotally adjusting and selectively fixing said slide bar, about said means pivotally mounting said slide bar, relative to said slide block for aligning the front and rear sight elements of said sight span with the bow string, a radius bar, means for adjustably securing said radius bar to said bow, said radius bar being oriented generally vertically, parallel to said bow, and having a longitudinally curved portion thereof with a constant radius of curvature, and means for slidably mounting said slide block on said radius bar for vertical adjustment generally parallel to the longitudinal axis of the bow to enable a vertical adjustment of the sight span for accommodating variations in the distance from the bow to a target, said slide block being selectively secured to said radius bar at a desired position along the curved portion thereof.

2. The archer's bow sight of claim 1 wherein the means for adjustably securing said radius bar to said bow includes a base bar spaced apart from and oriented generally parallel to said radius bar, an extension from one end of said base bar, said extension extending generally parallel to the longitudinal axis of said sight span, said radius bar, at one end thereof, being pivotally attached to the extension with the pivotal axis of the attachment being generally parallel to the lateral axis of said bow sight span, a rod extending from the other end of said base bar generally parallel to said extension, and the other end of said radius bar being adjustably secured at a desired position on said rod.

3. The archer's bow sight of claim 2 and further including a base mounting block adapted to be secured to said bow, said base bar being slidably mounted on said base mounting block such that the base bar slides along its length in a direction generally parallel to the vertical axis of said bow sight, and means for selectively fixing said base bar to said base mounting block.

4. The archer's bow sight of claim 3 and further including:

means for adjusting the angular orientation of said base bar to said mounting block about an axis generally parallel to the longitudinal axis of said sight span.

5. An archer's bow sight comprising: a sight span having spaced apart front and rear sight elements, and means for adjustably securing said sight span to the riser of a bow, said adjustable securing means including; means for aligning said front and rear sight elements with a bow string, means for moving said sight span to correct for crosswind effects on the flight path of an arrow shot from said bow, and means for vertically positioning said sight span to adjust for variations in the distance from the bow to a target; said sight span including a plurality of vertically spaced apart pairs of front and rear sight elements.

6. An archer's bow sight comprising: a sight span having spaced apart front and rear sight elements, and means for adjustably securing said sight span to the riser of a bow including; a slide block, means for adjustably mounting said slide block relative to the bow for vertical adjustment generally parallel to the longitudinal axis of the bow to enable a vertical adjustment of the sight span for accommodating variations in the distance from the bow to a target, a windage slide bar, means pivotally mounting said slide bar on said slide block for limited pivotal adjustment of the slide bar about a vertical axis generally parallel to the direction of adjustment of the slide block, said windage slide bar projecting laterally from said slide block so as to extend generally laterally of said bow, means slidably mounting said sight span on said slide bar for selective positioning of said sight span along said slide bar to correct for cross-wind effects on the flight path of an arrow shot from said bow, and means for pivotally adjusting and selectively fixing said slide bar, about said means pivotally mounting said slide bar, relative to said slide block for aligning the front and rear sight elements of said sight span with the bow string, said means for pivotally adjusting and selectively fixing said slide bar relative to said slide block comprising collar means fixed to said slide bar and adjustable screw means received through said collar means and threadedly secured within said slide block, said screw means being in bearing engagement with said collar means for a longitudinal adjustment of said collar means in response to a rotational adjustment of the screw means within said slide block.

* * * * *